US006410138B2

(12) United States Patent
Mleziva et al.

(10) Patent No.: US 6,410,138 B2
(45) **Date of Patent: *Jun. 25, 2002**

(54) CRIMPED MULTICOMPONENT FILAMENTS AND SPUNBOND WEBS MADE THEREFROM

(75) Inventors: Mark M. Mleziva, Appleton, WI (US); Samuel E. Marmon, Alpharetta, GA (US); Christopher C. Creagan, Marietta, GA (US); Darryl F. Clark; Kurtis L. Brown, both of Alpharetta, GA (US)

(73) Assignee: Kimberly-Clark Worldwide, Inc., Neenah, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/940,886

(22) Filed: Sep. 30, 1997

(51) Int. Cl.[7] ..... D01D 5/22; D01D 5/30; D02G 3/02

(52) U.S. Cl. ..... 428/369; 428/370; 428/373; 428/374

(58) Field of Search ..... 428/369, 370, 428/373, 374

(56) References Cited

U.S. PATENT DOCUMENTS

| | | | |
|---|---|---|---|
| 3,247,300 | A | 4/1966 | Stump |
| 3,491,178 | A | 1/1970 | Nishioka et al. |
| 3,895,165 | A | 7/1975 | Lohwasser et al. |
| 3,917,784 | A | 11/1975 | Nishida |
| 4,013,753 | A | 3/1977 | Lohwasser et al. |
| 4,115,620 | A | 9/1978 | Gupta et al. |
| 4,211,819 | A | 7/1980 | Kunimune et al. |

(List continued on next page.)

FOREIGN PATENT DOCUMENTS

| | | | |
|---|---|---|---|
| DE | 4209913 | A1 | 9/1993 |
| EP | 0395336 | A2 | 10/1990 |
| EP | 0518690 | A1 | 12/1992 |

(List continued on next page.)

OTHER PUBLICATIONS

"Copolymer Structure of Propylene Polymers," Encylcopedia of Polymer Science and Engineering, vol. 13, pp. 478–479, 1985.*

*Primary Examiner*—Cheryl Juska
(74) *Attorney, Agent, or Firm*—Dority & Manning, P.A.

(57) ABSTRACT

Spunbond multicomponent filaments and nonwoven webs made from the filaments are disclosed. In accordance with the present invention, the multicomponent filaments contain a crimp enhancement additive. Specifically, the crimp enhancement additive-is added to the polymeric component that has the slower solidification rate. The additive enhances crimp, allows for highly crimped filaments to be made at low fiber linear densities, improves the integrity of unbonded webs made from the filaments, and produces webs with improved stretch and cloth-like properties. The additive incorporated into the filaments is a random copolymer of butylene and propylene.

20 Claims, 2 Drawing Sheets

U.S. PATENT DOCUMENTS

| | | | | |
|---|---|---|---|---|
| 4,364,890 | A | | 12/1982 | Treiber et al. |
| 4,451,589 | A | | 5/1984 | Morman et al. |
| 4,477,516 | A | | 10/1984 | Sugihara et al. |
| 4,596,742 | A | | 6/1986 | Selivansky et al. |
| 4,632,861 | A | | 12/1986 | Vassilatos |
| 4,783,231 | A | | 11/1988 | Raley |
| 4,814,032 | A | | 3/1989 | Taniguchi et al. |
| 4,830,904 | A | | 5/1989 | Gessner et al. |
| 4,840,846 | A | | 6/1989 | Ejima et al. |
| 5,082,720 | A | | 1/1992 | Hayes |
| 5,093,197 | A | | 3/1992 | Howard et al. |
| 5,108,820 | A | | 4/1992 | Kaneko et al. |
| 5,126,219 | A | | 6/1992 | Howard et al. |
| 5,133,917 | A | | 7/1992 | Jezic et al. |
| 5,165,979 | A | | 11/1992 | Watkins et al. |
| 5,204,174 | A | | 4/1993 | Daponte et al. |
| 5,209,984 | A | | 5/1993 | Rolando et al. |
| H1213 | H | | 7/1993 | Hwo |
| 5,230,949 | A | | 7/1993 | Howard et al. |
| 5,246,763 | A | | 9/1993 | Murschall et al. |
| 5,266,392 | A | | 11/1993 | Land et al. |
| 5,281,670 | A | | 1/1994 | Lee et al. |
| 5,352,520 | A | | 10/1994 | Kitajima et al. |
| 5,382,400 | A | | 1/1995 | Pike et al. |
| H1419 | H | | 2/1995 | Wilpers et al. |
| 5,403,426 | A | | 4/1995 | Johnson et al. |
| 5,418,045 | A | | 5/1995 | Pike et al. |
| 5,424,115 | A | | 6/1995 | Stokes |
| 5,455,110 | A | | 10/1995 | Connor |
| 5,456,982 | A | | 10/1995 | Hansen et al. |
| 5,460,884 | A | | 10/1995 | Kobylivker et al. |
| 5,474,820 | A | | 12/1995 | Murschall et al. |
| 5,482,772 | A | | 1/1996 | Strack et al. |
| 5,489,454 | A | | 2/1996 | Peiffer et al. |
| 5,492,757 | A | | 2/1996 | Schuhmann et al. |
| 5,496,600 | A | | 3/1996 | Peiffer et al. |
| 5,508,102 | A | | 4/1996 | Georger et al. |
| 5,512,358 | A | | 4/1996 | Shawver et al. |
| 5,516,563 | A | | 5/1996 | Schumann et al. |
| 5,540,976 | A | | 7/1996 | Shawver et al. |
| 5,540,979 | A | | 7/1996 | Yahiaoui et al. |
| 5,545,464 | A | | 8/1996 | Stokes |
| 5,578,370 | A | | 11/1996 | Ferrar et al. |
| 5,587,229 | A | | 12/1996 | Clementini et al. |
| 5,597,645 | A | * | 1/1997 | Pike et al. ..... 96/99 |
| 5,597,647 | A | | 1/1997 | Powers |
| 5,622,772 | A | * | 4/1997 | Stokes et al. ..... 442/401 |
| 5,652,051 | A | | 7/1997 | Shawver et al. |
| 5,759,926 | A | | 6/1998 | Pike et al. |
| 5,855,784 | A | | 1/1999 | Pike et al. |
| 5,876,840 | A | * | 3/1999 | Ning et al. ..... 428/198 |

FOREIGN PATENT DOCUMENTS

| | | | |
|---|---|---|---|
| EP | 0696655 | A1 | 2/1996 |
| GB | 896955 | | 5/1962 |
| GB | 1134924 | | 11/1968 |
| GB | 1343449 | | 1/1974 |
| JP | 68026335 | | 11/1968 |
| JP | 70003886 | | 2/1970 |
| JP | 7103815 | | 1/1971 |
| JP | 4626895 | | 8/1971 |
| JP | 72048189 | | 12/1972 |
| JP | 56140167 | | 11/1981 |
| JP | 0173333 | A | 10/1984 |
| JP | 2184118 | A | 8/1987 |
| JP | 2299514 | A | 12/1987 |
| JP | 3105111 | | 5/1988 |
| JP | 3243324 | | 10/1988 |
| JP | 1266217 | | 10/1989 |
| JP | 2091217 | A | 3/1990 |
| JP | 2139469 | A | 5/1990 |
| JP | 2191717 | A | 7/1990 |
| JP | 002191720 | | 7/1990 |
| JP | 02200859 | | 8/1990 |
| JP | 3161504 | A | 7/1991 |
| JP | 3167314 | A | 7/1991 |
| JP | 3193958 | A | 8/1991 |
| JP | 3241054 | A | 10/1991 |
| JP | 3241055 | A | 10/1991 |
| JP | 3287818 | A | 12/1991 |
| JP | 04018121 | | 1/1992 |
| JP | 5147179 | A | 6/1993 |
| JP | 5192240 | A | 8/1993 |
| JP | 5311516 | A | 11/1993 |
| WO | WO9627041 | | 9/1996 |

* cited by examiner

CRIMPED MULTICOMPONENT FILAMENTS AND SPUNBOND WEBS MADE THEREFROM

FIELD OF THE INVENTION

The present invention is generally directed to spunbond multicomponent filaments and to nonwoven webs made from the filaments. More particularly, the present invention is directed to incorporating an additive into one of the polymers used to make multicomponent filaments. The additive enhances crimp, allows for finer filaments, improves the integrity of unbonded webs made from the filaments, enhances bonding of the filaments, and produces webs with improved stretch and cloth-like properties. The additive incorporated into the filaments is a butylene-propylene random copolymer.

BACKGROUND OF THE INVENTION

Nonwoven fabrics are used to make a variety of products which desirably have particular levels of softness, strength, uniformity, liquid handling properties such as absorbency, and other physical properties. Such products include towels, industrial wipers, incontinence products, filter products, infant care products such as baby diapers, absorbent feminine care products, and garments such as medical apparel. These products are often made with multiple layers of nonwoven fabrics to obtain the desired combination of properties. For example, disposable baby diapers made from polymeric nonwoven fabrics may include a soft and porous liner layer which fits next to the baby's skin, an impervious outer cover layer which is strong and soft, and one or more interior liquid handling layers which are soft, bulky and absorbent.

Nonwoven fabrics such as the foregoing are commonly made by melt spinning thermoplastic materials. Such fabrics are called spunbond materials. Spunbond nonwoven polymeric webs are typically made from thermoplastic materials by extruding the thermoplastic material through a spinneret and drawing the extruded material into filaments with a stream of high velocity air to form a random web on a collecting surface.

Spunbond materials with desirable combinations of physical properties, especially combinations of softness, strength and absorbency, have been produced, but limitations have been encountered. For example, for some applications, polymeric materials such as polypropylene may have a desirable level of strength but not a desirable level of softness. On the other hand, materials such as polyethylene may, in some cases, have a desirable level of softness but not a desirable level of strength.

In an effort to produce nonwoven materials having desirable combinations of physical properties, nonwoven polymeric fabrics made from multicomponent or bicomponent filaments and fibers have been developed. Bicomponent or multicomponent polymeric fibers or filaments include two or more polymeric components which remain distinct. As used herein, filaments mean continuous strands of material and fibers mean cut or discontinuous strands having a definite length. The first and subsequent components of multicomponent filaments are arranged in substantially distinct zones across the cross-section of the filaments and extend continuously along the length of the filaments. Typically, one component exhibits different properties than the other so that the filaments exhibit properties of the two components. For example, one component may be polypropylene which is relatively strong and the other component may be polyethylene which is relatively soft. The end result is a strong yet soft nonwoven fabric.

To increase the bulk or fullness of the bicomponent nonwoven webs for improved fluid management performance or for enhanced "cloth-like" feel of the webs, the bicomponent filaments or fibers are often crimped. Bicomponent filaments may be either mechanically crimped or, if the appropriate polymers are used, naturally crimped. As used herein, a naturally crimped filament is a filament that is crimped by activating a latent crimp contained in the filaments. For instance, in one embodiment, filaments can be naturally crimped by subjecting the filaments to a gas, such as a heated gas, after being drawn.

In general, it is far more preferable to construct filaments that can be naturally crimped as opposed to having to crimp the filaments in a separate mechanical process. Difficulties have been experienced in the past, however, in producing filaments that will crimp naturally to the extent required for the particular application. Also, it has been found to be very difficult to produce naturally crimped fine filaments, such as filaments having a linear density of less than 2 denier. Specifically, the draw force used to produce fine filaments usually prevents or removes any meaningful latent crimp that may be contained in the filaments. As such, currently a need exists for a method of producing multicomponent filaments with enhanced natural crimp properties. Also, a need exists for nonwoven webs made from such filaments.

SUMMARY OF THE INVENTION

The present invention recognizes and addresses the foregoing disadvantages, and others of prior art constructions and methods.

Accordingly, an object of the present invention is to provide improved nonwoven fabrics and methods for making the same.

Another object of the present invention is to provide nonwoven polymeric fabrics including highly crimped filaments and methods for economically making the same.

A further object of the present invention is to provide a method for controlling the properties of a nonwoven polymeric fabric by varying the degree of crimp of filaments and fibers used to make the fabric.

Another object of the present invention is to provide an improved process for naturally crimping multicomponent filaments.

It is another object of the present invention to provide a method for naturally crimping multicomponent filaments by adding to one of the components of the filaments a butylene-propylene copolymer.

Still another object of the present invention is to provide a naturally crimped filament that has a linear density of less than 2 denier.

Another object of the present invention is to provide a bicomponent filament made from polypropylene and polyethylene, wherein a crimp enhancement additive has been added to the polyethylene.

It is still another object of the present invention to provide a process for naturally crimping multicomponent filaments containing polypropylene and polyethylene in which a crimp enhancement additive and reclaimed polymer has been added to the polyethylene.

Another object of the present invention is to provide a crimp enhancement additive that also improves the strength of unbonded webs made from filaments containing the additive.

These and other objects of the present invention are achieved by providing a process for forming a nonwoven web. The process includes the steps of melt spinning multicomponent filaments. The multicomponent filaments include a first polymeric component and a second polymeric component. The first polymeric component has a faster solidification rate than the second polymeric component for providing the filaments with a latent crimp. The second polymeric component contains a crimp enhancement additive that is a butylene-propylene copolymer.

Once melt spun, the multicomponent filaments are drawn and naturally crimped. Thereafter, the multicomponent crimped filaments are formed into a nonwoven web for use in various applications.

In one embodiment, the second polymeric component can include polyethylene. The butylene-propylene copolymer can be added to the second polymeric component in an amount less than about 10% by weight, and particularly from about 0.5% to about 5% by weight. Preferably, the butylene-propylene copolymer is a random copolymer containing less than about 20% by weight butylene, and particularly about 14% by weight butylene.

The first polymeric component, on the other hand, in one preferred embodiment is polypropylene. Other polymers that may be used include nylon, polyester and copolymers of polypropylene, such as a propylene-ethylene copolymer.

In accordance with the present invention, it has been also discovered that the butylene-propylene copolymer also functions as a polymer compatibilizer. In particular, it has been found that the copolymer allows better homogeneous mixing between different polymers. In this regard, the first polymeric component, in accordance with the present invention, can also contain reclaim polymer. Reclaim polymer, as used herein, are polymer scraps that are recycled and added to the filaments. For instance, the reclaim polymer can comprise a mixture of polyethylene, polypropylene, and copolymers of propylene and ethylene, and can be obtained from the trimmed edges of previously formed nonwoven webs. In the past, difficulties were experienced in recycling reclaim polymer, especially bicomponent reclaim polymer, and incorporating them into filaments without adversely affecting the physical properties of the filaments.

These and other objects of the present invention are also achieved by providing a nonwoven web made from spunbond multicomponent, crimped filaments. The multicomponent crimped filaments are made from at least a first polymeric component and a second polymeric component. In particular, the polymeric components are selected such that the first polymeric component has a faster solidification rate than the second polymeric component. In accordance with the present invention, the second polymeric component contains a crimp enhancement additive. Specifically, the crimp enhancement additive is a butylene-propylene random copolymer.

For instance, in one embodiment, the crimped filaments can be bicomponent filaments which include a polypropylene component and a polyethylene component. The butylene-propylene random copolymer can be added to the polyethylene component in an amount up to about 5% by weight. Preferably, the butylene-propylene random copolymer contains about 14% by weight butylene.

Because of the addition of the crimp enhancement additive, the multicomponent filaments can have a very low denier and still be crimped naturally. For instance, the denier of the filaments can be less than 2, and particularly less than about 1.2.

In this regard, the present invention is also directed to a naturally crimped multicomponent filament that includes at least a first polymeric component and a second polymeric component. The first polymeric component can be, for instance, polypropylene. The second polymeric component, on the other hand, can be, for instance, polyethylene and can contain a crimp enhancement additive in an amount sufficient to allow the filaments to be naturally crimped at a denier of less than about 2 and particularly less than about 1.2.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
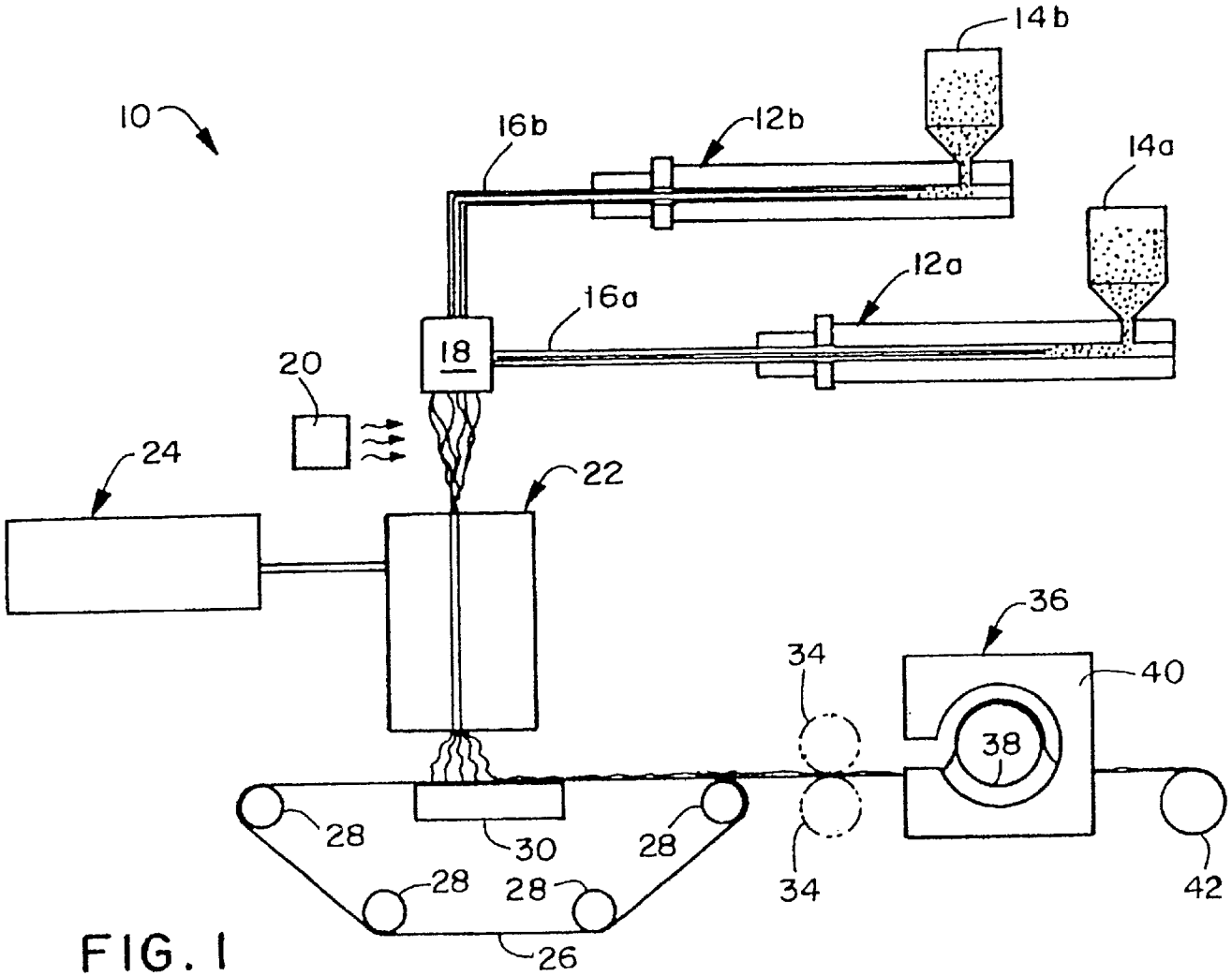
FIG. 1 is a schematic drawing of a process line for making a preferred embodiment of the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

The present invention is generally directed to multicomponent filaments and to spunbond webs produced from the filaments. In particular, the filaments are naturally crimped into, for instance, a helical arrangement. Crimping the filaments increases the bulk, the softness, and the drapability. The nonwoven webs also have improved fluid management properties and have an enhanced cloth-like appearance and feel.

Multicomponent filaments for use in the present invention contain at least two polymeric components. The polymeric components can be, for instance, in a side-by-side configuration or in an eccentric sheath-core configuration. The polymeric components are selected from semi-crystalline and crystalline thermoplastic polymers which have different solidification rates with respect to each other in order for the filaments to undergo natural crimping. More particularly, one of the polymeric components has a faster solidifying rate than the other polymeric component.

As used herein, the solidification rate of a polymer refers to the rate at which a softened or melted polymer hardens and forms a fixed structure. It is believed that the solidification rate of a polymer is influenced by different parameters including the melting temperature and the rate of crystallization of the polymer. For instance, a fast solidifying polymer typically has a melting point that is about 10° C. or higher, more desirably about 20° C. or higher, and most desirably about 30° C. or higher than a polymer that has a slower solidifying rate. It should be understood, however, that both polymeric components may have similar melting points if their crystallization rates are measurably different.

Although unknown, it is believed that the latent crimpability of multicomponent filaments is created in the filaments due to the differences in the shrinkage properties between the polymeric components. Further, it is believed that the main cause of the shrinkage difference between polymeric components is the incomplete crystallization of the slower solidifying polymer during the fiber production process. For instance, during formation of the filaments, when the fast solidifying polymer is solidified, the slow solidifying polymer is partially solidified and does not measurably draw any longer and thus does not further experience a significant orienting force. In the absence of an orienting force, the slow solidified polymer does not significantly further crystallize while being cooled and solidified. Accordingly, the resulting filaments possess latent crimpability, and such latent crimpability can be activated by subjecting the filaments to a process that allows sufficient molecular movement of the polymer molecules of the slow solidifying polymer to facilitate further crystallization and shrinkage.

The present invention is directed to adding a crimp enhancement additive to the polymeric component having the slower solidification rate in order to further slow the solidification rate of the polymer. In this manner, the differences between the solidification rates of both polymeric components becomes even greater creating multicomponent filaments that have an enhanced latent crimpability. In particular, the crimp enhancement additive of the present invention is a random butylene-propylene copolymer.

Besides creating multicomponent filaments that have a greater natural crimp, it has also been discovered that the crimp enhancement additive of the present invention provides many other benefits and advantages. For instance, because the filaments of the present invention have a greater degree of crimping, fabrics and webs made from the filaments have a higher bulk and a lower density. By being able to make lower density webs, less material is needed to make webs of a specified thickness and the webs are thus less expensive to produce. Besides having lower densities, the webs have also been found to be more cloth-like, to have a softer hand, to have more stretch, to have better recovery, and to have better abrasion resistance.

Of particular advantage, it has also been unexpectedly discovered that the crimp enhancement additive of the present invention further improves the strength and integrity of unbonded webs made from the filaments. For instance, it was discovered that adding only 1% by weight of the additive can more than double the unbonded strength of the web. By having greater unbonded web integrity, the webs of the present invention may be processed at faster speeds. In the past, in order to run at higher speeds, unbonded spunbond webs had to be prebonded or compacted. Such steps are not necessary when processing webs made according to the present invention.

Besides have increased strength, spunbond webs made according to the present invention also have dramatically reduced web handling problems when processed at higher speeds. For instance, the occurrences of eyebrows, flip overs and stretch marks are significantly reduced when the crimp enhancement additive is present within the filaments. More particularly, webs incorporating filaments made according to the present invention have a lesser tendency to protrude from the web but, instead, have a greater tendency to lay down on the web surface. As such, the filaments are less likely to penetrate the foraminous surface upon which the web is formed, thus making it easier to remove the web from the surface.

Another unexpected benefit to using the crimp enhancement additive of the present invention is that the additive also functions as polymer compatabilizer. In other words, the additive facilitates homogeneous mixing of different polymers. Thus, the polymeric component containing the additive can contain a mixture of polymers if desired. For example, in one embodiment of the present invention, the polymeric component containing the additive of the present invention can also contain reclaim polymer, such as polymeric scraps collected from the trimmings of previously formed spunbond webs and particularly bicomponent webs.

A further advantage to the crimp enhancement additive of the present invention is that the additive permits the formation of very fine multicomponent filaments having a relatively high natural crimp. In the past, it was very difficult to create fine filaments, such as at less than 2 denier, that had a relatively high natural crimp. In the past, the draw force used to produce fine fibers usually prevented or removed any meaningful latent crimp present within the filaments. Filaments made according to the present invention, on the other hand, can have greater than 10 crimps per inch at less than 2 denier, and even lower than 1.2 denier.

Besides the above-listed advantages, it has also been discovered that the crimp enhancement additive of the present invention improves thermal bonding between the filaments. In particular, the crimp enhancement additive has a broad melting point range and has a relatively low melt temperature, which facilitates bonding.

The webs and fabrics of the present invention are particularly useful for making various products including liquid and gas filters, personal care articles and garment materials. Personal care articles include infant care products such as disposable baby diapers, child care products such as training pants, and adult care products such as incontinence products and feminine care products. Suitable garments include medical apparel, work wear, and the like.

As described above, the fabric of the present invention includes continuous multicomponent polymeric filaments comprising at least first and second polymeric components. A preferred embodiment of the present invention is a polymeric fabric including continuous bicomponent filaments comprising a first polymeric component A and a second polymeric component B. The bicomponent filaments have a cross-section, a length, and a peripheral surface. The first and second components A and B are arranged in substantially distinct zones across the cross-section of the bicomponent filaments and extend continuously along the length of the bicomponents filaments. The second component B constitutes at least a portion of the peripheral surface of the bicomponent filaments continuously along the length of the bicomponent filaments.

Figure 2A:
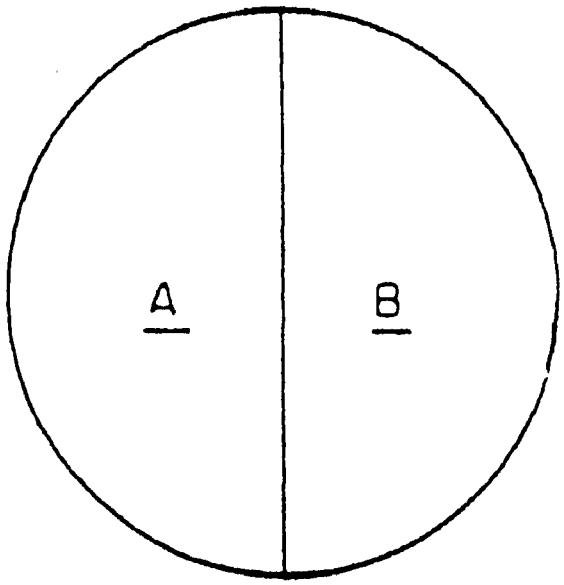
FIG. 2A is a schematic drawing illustrating the cross section of a filament made according to an embodiment of the present invention with the polymer components A and B in a side-by-side arrangement.
Figure 2B:
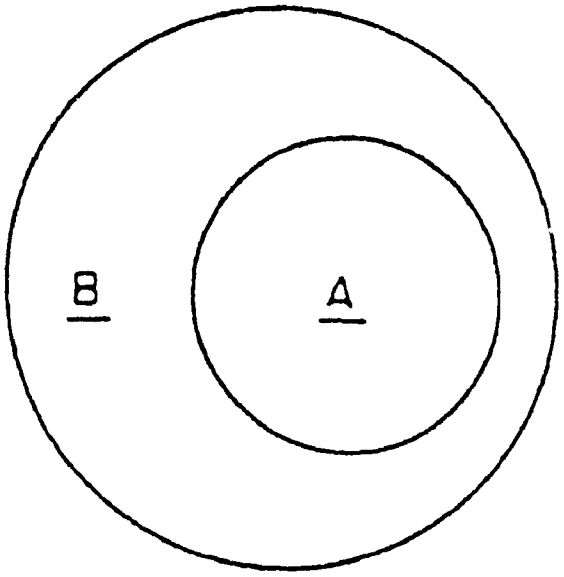
FIG. 2B is a schematic drawing illustrating the cross section of a filament made according to an embodiment of the present invention with the polymer components A and B in a eccentric sheath/core arrangement.

The first and second components A and B are arranged in either a side-by-side arrangement as shown in FIG. 2A or an eccentric sheath/core arrangement as shown in FIG. 2B so that the resulting filaments exhibit a natural helical crimp. Polymer component A is the core of the filament and polymer component B is the sheath in the sheath/core arrangement. Methods for extruding multicomponent polymeric filaments into such arrangements are well-known to those of ordinary skill in the art.

A wide variety of polymers are suitable to practice the present invention including polyolefins (such as polyethylene and polypropylene), polyesters, polyamides, and the like. Polymer component A and polymer component B must be selected so that the resulting bicomponent filament is capable of developing a natural helical crimp. Preferably, polymer component A has a faster solidification rate than polymer component B. For instance, in one embodiment, polymer component A can have a higher melting temperature than polymer component B.

Preferably, polymer component A comprises polypropylene or a random copolymer of propylene and ethylene. Besides containing polypropylene, polymer component A can also be a nylon or a polyester.

Polymer component B, on the other hand, preferably comprises polyethylene or a random copolymer of propylene and ethylene. Preferred polyethylenes include linear low density polyethylene and high density polyethylene.

Suitable materials for preparing the multicomponent filaments of the present invention include PD-3445 polypropylene available from Exxon of Houston, Tex., random copolymer of propylene and ethylene available from Exxon, ASPUN 6811A and 2553 linear low density polyethylene available from the Dow Chemical Company of Midland, Mich., 25355 and 12350 high density polyethylene available from the Dow Chemical Company.

When polypropylene is component A and polyethylene is component B, the bicomponent filaments may comprise from about 20 to about 80% by weight polypropylene and from about 20 to about 80% polyethylene. More preferably, the filaments comprise from about 40 to about 60% by weight polypropylene and from about 40 to about 60% by weight polyethylene.

As described above, the crimp enhancement additive of the present invention is a random copolymer of butylene and propylene and is added to polymer component B which is preferably polyethylene. The butylene-propylene random copolymer preferably contains from about 5% to about 20% by weight butylene. For instance, one commercially available product that may be used as the crimp enhancement additive is Product No. DS4D05 marketed by the Union Carbide Corporation of Danbury, Conn. Product No. DS4D05 is a butylene-propylene random copolymer containing 14% by weight butylene and 86% by weight propylene. Preferably, the butylene-propylene copolymer is a film grade polymer having an MFR (melt flow rate) of from about 3.0 to about 15.0, and particularly having a MFR of from about 5 to about 6.5.

In order to combine the crimp enhancement additive with polymer component B, in one embodiment, the polymers can be dry blended and extruded together during formation of the multicomponent filaments. In an alternative embodiment, the crimp enhancement additive and polymer component B which can be, for instance, polyethylene, can be melt blended prior to being formed into the filaments of the present invention.

In general, the crimp enhancement additive can be added to polymeric component B in an amount less than 10% by weight. When polymeric component B contains polyethylene, preferably the crimp enhancement additive is added in an amount from about 0.5% to about 5% by weight based upon the total weight of polymer component B. Should too much of the butylene-propylene random copolymer be added to the polymer component, the resulting filaments may become too curly and adversely interfere with the formation of a nonwoven web.

It is believed that the butylene-propylene random copolymer, when added to a polymer such as polyethylene, slows the solidification rate and the crystallization rate of the polymer. In this manner, a greater difference in solidification rates is created between the different polymer components used to make the filaments, thereby increasing the latent crimpability of the filaments.

In an alternative embodiment of the present invention, besides adding the crimp enhancement additive to polymer component B, reclaimed and recycled polymers are also added to the polymer component. As described above, it has been discovered that the crimp enhancement additive of the present invention also facilitates homogeneous mixing between polymers. Specifically, the butylene-propylene random copolymer has been found to facilitate mixing between polyethylene and a reclaim polymer that contains a mixture of polyethylene and polypropylene. In this embodiment, the reclaim polymer can be added to the polymeric component in an amount up to about 20% by weight. Preferably, the reclaim polymer is collected from scraps and trimmings of previously formed nonwoven webs. Being able to recycle such polymers not only decreases the amount of materials needed to make the nonwoven webs of the present invention, but also limits the amount of waste that is produced.

One process for producing multicomponent filaments and nonwoven webs according to the present invention will now be discussed in detail with reference to FIG. 1. The following process is similar to the process described in U.S. Pat. No. 5,382,400 to Pike et al., which is incorporated herein by reference in its entirety.

Turning to FIG 1, a process line 10 for preparing a preferred embodiment of the present invention is disclosed. The process line 10 is arranged to produce bicomponent continuous filaments, but it should be understood that the present invention comprehends nonwoven fabrics made with multicomponent filaments having more than two components. For example, the fabric of the present invention can be made with filaments having three or four components.

The process line 10 includes a pair of extruders 12*a* and 12*b* for separately extruding a polymer component A and a polymer component B. Polymer component A is fed into the respective extruder 12*a* from a first hopper 14*a* and polymer component B is fed into the respective extruder 12*b* from a second hopper 14*b*. Polymer components A and 3 are fed from the extruders 12*a* and 12*b* through respective polymer conduits 16*a* and 16*b* to a spinneret 18.

Spinnerets for extruding bicomponent filaments are well-known to those of ordinary skill in the art and thus are not described here in detail. Generally described, the spinneret 18 includes a housing containing a spin pack which includes a plurality of plates stacked one on top of the other with a pattern of openings arranged to create flow paths for directing polymer components A and B separately through the spinneret. The spinneret 18 has openings arranged in one or more rows. The spinneret openings form a downwardly extending curtain of filaments when the polymers are extruded through the spinneret. For the purposes of the present invention, spinneret 18 may be arranged to form side-by-side or eccentric sheath/core bicomponent filaments illustrated in FIGS. 2A and 2B.

The process line 10 also includes a quench blower 20 positioned adjacent the curtain of filaments extending from the spinneret 18. Air from the quench air blower 20 quenches the filaments extending from the spinneret 18. The quench air can be directed from one side of the filament curtain as shown FIG. 1, or both sides of the filament curtain.

A fiber draw unit or aspirator 22 is positioned below the spinneret 18 and receives the quenched filaments. Fiber draw units or aspirators for use in melt spinning polymers are well-known as discussed above. Suitable fiber draw units for use in the process of the present invention include a linear fiber aspirator of the type shown in U.S. Pat. No. 3,802,817 and educative guns of the type shown in U.S. Patent Nos. 3,692,618 and 3,423,266, the disclosures of which are incorporated herein by reference.

Generally described, the fiber draw unit 22 includes an elongate vertical passage through which the filaments are drawn by aspirating air entering from the sides of the passage and flowing downwardly through the passage. A heater or blower 24 supplies aspirating air to the fiber draw unit 22. The aspirating air draws the filaments and ambient air through the fiber draw unit.

An endless foraminous forming surface 26 is positioned below the fiber draw unit 22 and receives the continuous filaments from the outlet opening of the fiber draw unit. The forming surface 26 travels around guide rollers 28. A vacuum 30 positioned below the forming surface 26 where the filaments are deposited draws the filaments against the forming surface.

The process line 10 further includes a bonding apparatus such as thermal point bonding rollers 34 (shown in phantom) or a through-air bonder 36. Thermal point bonders and through-air bonders are well-known to those skilled in the art and are not disclosed here in detail. Generally described, the through-air bonder 36 includes a perforated roller 38, which receives the web, and a hood 40 surrounding the perforated roller. Lastly, the process line 10 includes a winding roll 42 for taking up the finished fabric.

To operate the process line 10, the hoppers 14*a* and 14*b* are filled with the respective polymer components A and B. Polymer components A and B are melted and extruded by the respective extruders 12*a* and 12*b* through polymer conduits 16*a* and 16*b* and the spinneret 18. Although the temperatures of the molten polymers vary depending on the polymers used, when polypropylene and polyethylene are used as components A and B respectively, the preferred temperatures of the polymers when extruded range from about 370° to about 530° F. and preferably range from 400° to about 450° F.

As the extruded filaments extend below the spinneret 18, a stream of air from the quench blower 20 at least partially quenches the filaments to develop a latent helical crimp in the filaments. The quench air preferably flows in a direction substantially perpendicular to the length of the filaments at a temperature of about 45° to about 90° F. and a velocity of from about 100 to about 400 feet per minute.

After quenching, the filaments are drawn into the vertical passage of the fiber draw unit 22 by a flow of a gas, such as air, from the heater or blower 24 through the fiber draw unit. The fiber draw unit is preferably positioned 30 to 60 inches below the bottom a of the spinneret 18. The temperature of the air supplied from the heater or blower 24 is sufficient to activate the latent crimp. The temperature required to activate the latent crimp of the filaments ranges from about 60° F. to a maximum temperature near the melting point of the lower melting component which is the second component B.

The actual temperature of the air being supplied by heater or blower 24 generally will depend upon the linear density of the filaments being produced. For instance, it has been discovered that at greater than 2 denier, no heat is required at the fiber draw unit 22 in order to naturally crimp the filaments, which is a further advantage of the present invention. In the past, air being supplied to the fiber draw unit 22 typically had to be heated. Filaments finer than about 2 denier made according to the present invention, however, generally will need to be contacted with heated air in order to induce natural crimping.

The temperature of the air from the heater 24 can be varied to achieve different levels of crimp. Generally, a higher air temperature produces a higher number of crimps. The ability to control the degree of crimp of the filaments is particularly advantageous because it allows one to change the resulting density, pore size distribution and drape of the fabric by simply adjusting the temperature of the air in the fiber draw unit.

The crimped filaments are deposited through the outlet opening of the fiber draw unit 22 onto the traveling forming surface 26. The vacuum 20 draws the filaments against the forming surface 26 to form an unbonded, nonwoven web of continuous filaments. In the past, the web was then typically lightly compressed by a compression roller and then thermal point bonded by rollers 34 or through-air bonded in the through-air bonder 36. As described above, however, it has been discovered that nonwoven webs made according to the present invention have increased strength and integrity when containing the crimp enhancement additive. As such, very little prebonding by a compression roller or any other type of prebonding station is necessary in process line 10 prior to feeding the webs to a bonding station, Further, due to the increased strength of nonbonded webs made according to the present invention, line speeds can be increased. For instance, line speeds can range from about 150 feet per minute to about 500 feet per minute.

In the through-air bonder 36 as shown in FIG. 1, air having a temperature above the melting temperature of component B and below the melting temperature of component A is directed from the hood 40, through the web, and into the perforated roller 38. The hot air melts the lower melting polymer component B and thereby forms bonds between the bicomponent filaments to integrate the web. When polypropylene and polyethylene are used as polymer components A and B respectively, the air flowing through the through-air bonder preferably has a temperature ranging from about 230° to about 280° F. and a velocity from about 100 to about 500 feet per minute. The dwell time of the web in the through-air bonder is preferably less than about 6 seconds. It should be understood, however, that the parameters of the through-air bonder depend on factors such as the type of polymers used and thickness of the web.

Lastly, the finished web is wound onto the winding roller 42 and is ready for further treatment or use. When used to make liquid absorbent articles, the fabric of the present invention may be treated with conventional surface treatments or contain conventional polymer additives to enhance the wettability of the fabric. For example, the fabric of the present invention say be treated with polyalkylene-oxide modified siloxanes and silanes such as polyalkylene-oxide modified polydimethyl-siloxane as disclosed in U.S. Pat. No. 5,057,361. Such a surface treatment enhances the wettability of the fabric.

When through-air bonded, the fabric of the present invention characteristically has a relatively high loft. The helical crimp of the filaments creates an open web structure with substantial void portions between filaments and the filaments are bonded at points of contact. The through-air bonded web of the present invention typically has a density of from about 0.015 g/cc to about 0.040 g/cc and a basis weight of from about 0.25 to about 5 oz. per square yard and more preferably from about 1.0 to about 3.5 oz. per square yard.

Filament linear density generally ranges from less 1.0 to about 8 denier. As discussed above, the crimp enhancement additive of the present invention allows for the production of highly crimped, fine filaments. In the past, naturally crimped fine filaments were difficult if not impossible to produce. According to the present invention, filaments having a natural crimp of at least about 10 crimps per inch can be produced at linear densities less than 2 denier, and particularly at less than about 1.2 denier. For most nonwoven webs, it is preferable for the filaments to have from about 10 crimps per inch to about 25 crimps per inch. Of particular advantage, filaments having a natural crimp in the above range can be produced according to the present invention at a lower linear density than what has been possible in the past.

Thermal point bonding may be conducted in accordance with U.S. Pat. No. 3,855,046, the disclosure of which is incorporated herein by reference. When thermal point bonded, the fabric of the present invention exhibits a more cloth-like appearance and, for example, is useful as an outer cover for personal care articles or as a garment material.

Although the methods of bonding shown in FIG. 1 are thermal point bonding and through-air bonding, it should be understood that the fabric of the present invention may be bonded by other means such as oven bonding, ultrasonic bonding, hydroentangling or combinations thereof. Such bonding techniques are well-known to those of ordinary skill in the art and are not discussed here in detail.

Although, the preferred method of carrying out the present invention includes contacting the multicomponent filaments with aspirating air, the present invention encompasses other methods of activating the latent helical crimp of the continuous filaments before the filaments are formed into a web. For example, the multicomponent filaments may be contacted with air after quenching but upstream of the aspirator. In addition, the multicomponent filaments may be contacted with air between the aspirator and the web forming surface. Furthermore, the filaments may also be exposed to electromagnetic energy such as microwaves or infrared radiation.

Once produced, the nonwoven webs of the present invention can be used in many different and various applications. For instance, the webs can be used in filter products, in liquid absorbent products, in personal care articles, in garments, and in various other products.

The present invention may be better understood with reference to the following Examples.

EXAMPLE NO. 1

The following Example was conducted in order to compare the differences between filaments and nonwoven webs made with the crimp enhancement additive of the present invention and filaments and nonwoven webs constructed without the crimp enhancement additive.

Two bicomponent spunbond fabrics were produced generally in accordance with the process disclosed in U.S. Pat. No 5,382,400 (Pike, et al). In both fabrics, the filaments were round in cross section with the two components arranged in a side-by-side configuration. One side of the filaments was made primarily of polypropylene (Exxon 34455), while the other side was made primarily of polyethylene (Dow 61800). In both fabrics, the polypropylene (PP) side contained in an amount of 2% by weight an additive composed of 50% polypropylene and 50% $TiO_2$.

In the first fabric (Fabric A), in accordance with the present invention, the polyethylene (PE) side contained in an amount of 2% by weight a random copolymer of 14% butylene and 86% propylene (Union Carbide DS4D05). The polyethylene side of the other fabric (Fabric B), on the other hand, was 100% polyethylene.

Both fabrics were produced at a total polymer throughput of 0.35 ghm of polymer per hole at a hole density of 48 holes per inch of width and were through air bonded at an air temperature of 265° F. Fabric A was produced at a line speed of 44 feet per minute, while Fabric B was produced at 37 feet per minute. Line speed was used to control basis weight, all other process conditions remained the same. Both fabrics had a basis weight of 2.6 ounces per square yard (osy).

The fabrics were tested for tensile peak load, peak strain and peak energy (3" strips) in both the machine direction (MD) and cross-machine direction (CD) according to ASTM D-5035-90 and for caliper under a load of 0.05 psi with a Starrett-type caliper tester. Fabric density was calculated from basis weight and caliper. Fiber crimp was rated on a subjective 1 to 5 scale with 1=no crimp and 5=very high crimp. Fiber linear density was calculated from the diameter of the filaments (measured by microscope) and the density of the polymer. The strength of the unbonded web was determined by collecting a length of fabric that had not yet entered the bonder and gently laying it on the floor. The fabric was then slowly and gently lifted by one end until tensile failure was noted. The length of the fabric that was lifted at the point of tensile failure was recorded as the breaking length of the unbonded web.

The test results are shown on the following table.

Properties of Fabrics A & B

| | Fabric A | Fabric B |
|---|---|---|
| Filament Linear Density (denier) | 1.3 | 1.3 |
| Filament Crimp Index | 4.0 | 1.0 |
| Fabric Basis Weight (osy) | 2.6 | 2.6 |
| Fabric Caliper (in) | 0.135 | 0.090 |
| Fabric Density (g/cc) | 0.026 | 0.038 |
| Unbonded Fabric Tensile Breaking Length (in) | 66 | 18 |
| Bonded Fabric Tensile Properties: | | |
| MD Peak Load (lb) | 6.5 | 10.9 |
| MD Peak Strain (%) | 46 | 20 |
| MD Peak Energy (in-lb) | 4.7 | 4.4 |
| CD Peak Load (lb) | 10.6 | 22.3 |
| CD Peak Strain (%) | 138 | 66 |
| CD Peak Energy (in-lb) | 24 | 32 |

The results show that Fabric A, relative to Fabric B, is composed of filaments having greater crimp and has a greater caliper (and therefore, lower density). Fabric A further has much greater unbonded web strength. While the tensile peak loads of Fabric B are about twice as large as those of Fabric A, the peak strain values of Fabric A are greater than those of Fabric B by about the same factor. Fabric peak energies, particularly in the machine direction, are similar.

Of particular significance, it is noted that the linear densities of both sets of filaments were very low, at about 1.3 denier. As shown, the filaments made containing the crimp enhancement additive of the present invention had a high natural crimp while the filaments not containing the additive experienced no significant crimp. As described above, in the past, it was very difficult to create a naturally crimped filament at low linear densities.

EXAMPLE NO. 2

The following example was conducted in order to demonstrate the ability of the additive of the present invention to facilitate mixing between different polymeric materials.

Polyethylene/polypropylene bicomponent filaments were produced and formed into a spunbond nonwoven web generally in accordance with the process described in Example 1 and disclosed in U.S. Pat. No. 5,382,400 to Pike, et al. The polyethylene side of the bicomponent filaments contained 20% by weight reclaim polymer. Specifically, the reclaim polymer was a mixture of polypropylene and polyethylene that had been collected from the trimmings of a previously formed nonwoven web.

In accordance with the present invention, the polyethylene component also contained 5% by weight of the butylene/propylene random copolymer identified in Example 1.

It was observed that by adding the butylene/propylene copolymer of the present invention, the reclaim polymer readily blended with the polyethylene component and produced a polymeric material that could be spun into filaments, which, in turn, could be naturally crimped. Further, it was discovered that filaments with very low linear densities could be produced. For instance, at a polymer throughput of 0.4 ghm and at a fiber draw pressure of 7.4 psi, filaments were produced having a linear density of 1.18 denier.

In the past, attempts have been made to produce bicomponent filaments containing reclaim polymer. Absent adding the additive of the present invention, however, it was not possible to spin the polymer mixture into filaments.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A naturally crimped multicomponent filament comprising at least a first polymeric component and a second polymeric component, said first polymeric component having a faster solidification rate than said second polymeric component, said filament containing a crimp enhancement additive comprising a butylene-propylene random copolymer, wherein the units of said copolymer consists of butylene and propylene, said crimp enhancement additive being added in an amount sufficient for said filament to have at least 10 crimps per inch, said multicomponent filament having a linear density of less than about 2 denier.

2. A naturally crimped multicomponent filament as defined in claim 1, wherein said filament has a linear density of less than about 1.2 denier.

3. A naturally crimped multicomponent filament as defined in claim 1, wherein said second polymeric component comprises polyethylene and wherein said crimp enhancement additive is contained within said second polymeric component.

4. A naturally crimped multicomponent filament as defined in claim 3, wherein said first polymeric component comprises polypropylene.

5. A naturally crimped multicomponent filament comprising a first polymeric component and a second polymeric component, said first polymeric component having a faster solidification rate than said second polymeric component, said second polymeric component comprising polyethylene or a random copolymer of ethylene and propylene, said second polymeric component containing a crimp enhancement additive, said crimp enhancement additive comprising a butylene-propylene random copolymer, wherein the units of said copolymer consists of butylene and propylene.

6. A naturally crimped multicomponent filament as defined in claim 5, wherein said second polymeric component comprises polyethylene.

7. A naturally crimped multicomponent filament as defined in claim 5, wherein said crimp enhancement additive is present in said second polymeric component in an amount up to about 10% by weight.

8. A naturally crimped multicomponent filament as defined in claim 5, wherein said first polymeric component comprises polypropylene.

9. A naturally crimped multicomponent filament as defined in claim 5, wherein said butylene-propylene random copolymer contains up to about 20% by weight butylene.

10. A naturally crimped multicomponent filament as defined in claim 5, wherein said filament has a linear density of less than about 2 denier.

11. A naturally crimped multicomponent filament as defined in claim 5, wherein said filament contains at least 10 crimps per inch.

12. A naturally crimped multicomponent filament as defined in claim 5, wherein said crimp enhancement additive is present within said second polymeric component in an amount up to about 5% by weight.

13. A naturally crimped multicomponent filament as defined in claim 5, wherein said first polymeric component comprises a material selected from the group consisting of nylon, polyester and propylene-ethylene copolymers.

14. A naturally crimped multicomponent filament as defined in claim 6, wherein said second polymeric component further comprises reclaimed polymers, said reclaimed polymers comprising polypropylene, polyethylene or copolymers of propylene and ethylene.

15. A naturally crimped bicomponent filament comprising a first polymeric component and a second polymeric component, said first polymeric component having a faster solidification rate than said second polymeric component, said second polymeric component comprising polyethylene, said second polymeric component containing a crimp enhancement additive, said crimp enhancing additive comprising a butylene-propylene random copolymer, wherein the units of said copolymer consists of butylene and propylene, said crimp enhancement additive being present in said second polymeric component in an amount up to about 10% by weight.

16. A naturally crimped bicomponent filament as defined in claim 15, wherein said first polymeric component comprises polypropylene.

17. A naturally crimped bicomponent filament as defined in claim 15, wherein said crimp enhancement additive is present in said second polymeric component in an amount up to about 5% by weight.

18. A naturally crimped bicomponent filament as defined in claim 15, wherein said butylene-propylene random copolymer contains up to about 20% by weight butylene.

19. A naturally crimped bicomponent filament as defined in claim 16, wherein said butylene-propylene random copolymer contains up to about 20% by weight butylene.

20. A naturally crimped bicomponent filament as defined in claim 15, wherein said filament contains at least 10 crimps per inch.

* * * * *